US005720423A

United States Patent [19]

Kondo et al.

[11] Patent Number: 5,720,423

[45] Date of Patent: Feb. 24, 1998

[54] FASTENER DRIVING TOOL

[75] Inventors: Masayoshi Kondo; Akira Mizumoto; Jiro Oda, all of Anjo, Japan

[73] Assignee: Makita Corporation, Anjo, Japan

[21] Appl. No.: 686,360

[22] Filed: Jul. 25, 1996

[30] Foreign Application Priority Data

Jul. 25, 1995 [JP] Japan ..... 7-189424
May 22, 1996 [JP] Japan ..... 8-127108

[51] Int. Cl.[6] ..... B25C 5/15

[52] U.S. Cl. ..... 227/130; 227/132; 227/146

[58] Field of Search ..... 227/129, 130, 227/131, 132, 134, 146, 133

[56] References Cited

U.S. PATENT DOCUMENTS

| | | | |
|---|---|---|---|
| 4,215,808 | 8/1980 | Sollberger et al. | 227/146 |
| 4,834,278 | 5/1989 | Lin | 227/131 |
| 5,004,140 | 4/1991 | Fushiya et al. | 227/8 |
| 5,118,023 | 6/1992 | Fushiya et al. | 227/8 |
| 5,503,319 | 4/1996 | Lai | 227/132 |
| 5,511,715 | 4/1996 | Crutcher et al. | 227/131 |

FOREIGN PATENT DOCUMENTS

| | | |
|---|---|---|
| 3728454 | 3/1989 | Germany . |
| 9004751 | 8/1990 | Germany . |
| 4442657 | 6/1995 | Germany . |

*Primary Examiner*—Joseph J. Hail, III
*Assistant Examiner*—Jay A. Stelacone
*Attorney, Agent, or Firm*—Dennison, Meserole, Pollack & Scheiner

[57] ABSTRACT

A fastener driving tool includes a cylinder and a drive piston reciprocally movable within the cylinder. A driver is connected to the drive piston and is operable to drive fasteners when the drive piston is moved in a driving direction. The drive piston defines a gas chamber in the cylinder for accommodating a gas. A drive mechanism is provided for moving the drive piston from a first position to a second position in a direction opposite to the driving direction for compressing the gas within the gas chamber. The drive mechanism is operable to permit movement of the drive piston in the driving direction by the pressure of the gas compressed within the gas chamber when the drive piston reaches the second position.

7 Claims, 9 Drawing Sheets

FASTENER DRIVING TOOL

FIELD OF THE INVENTION

The present invention relates to a fastener driving tool such as a nailer and a stapler.

DESCRIPTION OF THE PRIOR ART

A portable pneumatic nailer has been used to drive nails having a substantially T-shaped configuration into a work by using compressed air. However, in order to supply compressed air to the nailer, the nailer must be connected to a compressor as an air supply source by means of a hose.

On the other hand, a power driven stapler has been used to drive staplers having a substantially inverted U-shaped configuration by means of a spring which is biased by the driving force of a motor. In case of a power driven stapler having a motor for receiving supply of power from an external power source, the stapler is connected to a power source outlet by means of a cord when it is used. In case of a power driven stapler having a battery mounted thereon, the motor is not required to be connected to the external power source.

The power driven stapler having the battery is called a portable stapler and is advantageous since the stapler can be operated at a place where there is no power source outlet. In addition, since this stapler is not required to be connected to the power source for each driving operation, the driving operation can be efficiently performed.

However, with such a portable stapler, since the driving force depends on a restoring force of a spring (coil spring in a normal case) which is compressed by the driving force of a motor, the driving speed (restoring speed of the spring) is lower than the driving force produced by the pneumatic nailer which depends on the expanding force of the air (moving force of a piston). For this reason, a greater reaction force is applied to the stapler when the stapler is driven.

Thus, although the portable stapler is advantageous since it does not require a cord to be connected to an external power source or a hose to be connected to a compressor, the portable stapler involves a problem in the reaction force is greater than the force produced in case of the pneumatic nailer.

SUMMARY OF THE INVENTION

It is, accordingly, an object of the present invention to provide a fastener driving tool which is operable to drive fasteners without producing a great reaction force applied to the tool and which does not require to be connected to an external gas source.

It is another object of the present invention to provide such a fastener driving tool which does not require to be connected to an external power source.

It is a further object of the present invention to provide such a fastener driving tool which can drive fasteners by a stable driving force.

According to the present invention, there is provided a fastener driving tool comprising:

a cylinder;

a drive piston reciprocally movable within the cylinder and having a driver connected thereto, the driver being operable to drive fasteners when the drive piston is moved in a driving direction;

the drive piston defining a gas chamber in the cylinder for accommodating a gas; and a drive mechanism for moving the drive piston from a first position to a second position in a direction opposite to the driving direction for compressing the gas within the gas chamber, the drive mechanism being operable to permit movement of the drive piston in the driving direction by the pressure of the gas compressed within the gas chamber when the drive piston reaches the second position.

With this construction, the drive mechanism moves the drive piston to compress the gas within the gas chamber, so that the driver can be moved by the pressure of the compressed gas for driving the fasteners. Thus, the tool is operable to drive the fasteners without producing a great reaction force applied to the tool and does not require to be connected to an external gas source or a compressor.

The invention will become more apparent from the appended claims and the description as it proceeds in connection with the drawings.

DETAILED DESCRIPTION OF THE PREFERRED EMBODIMENTS

A first embodiment of the present invention will now be explained with reference to FIGS. 1 to 6.

Figure 1:
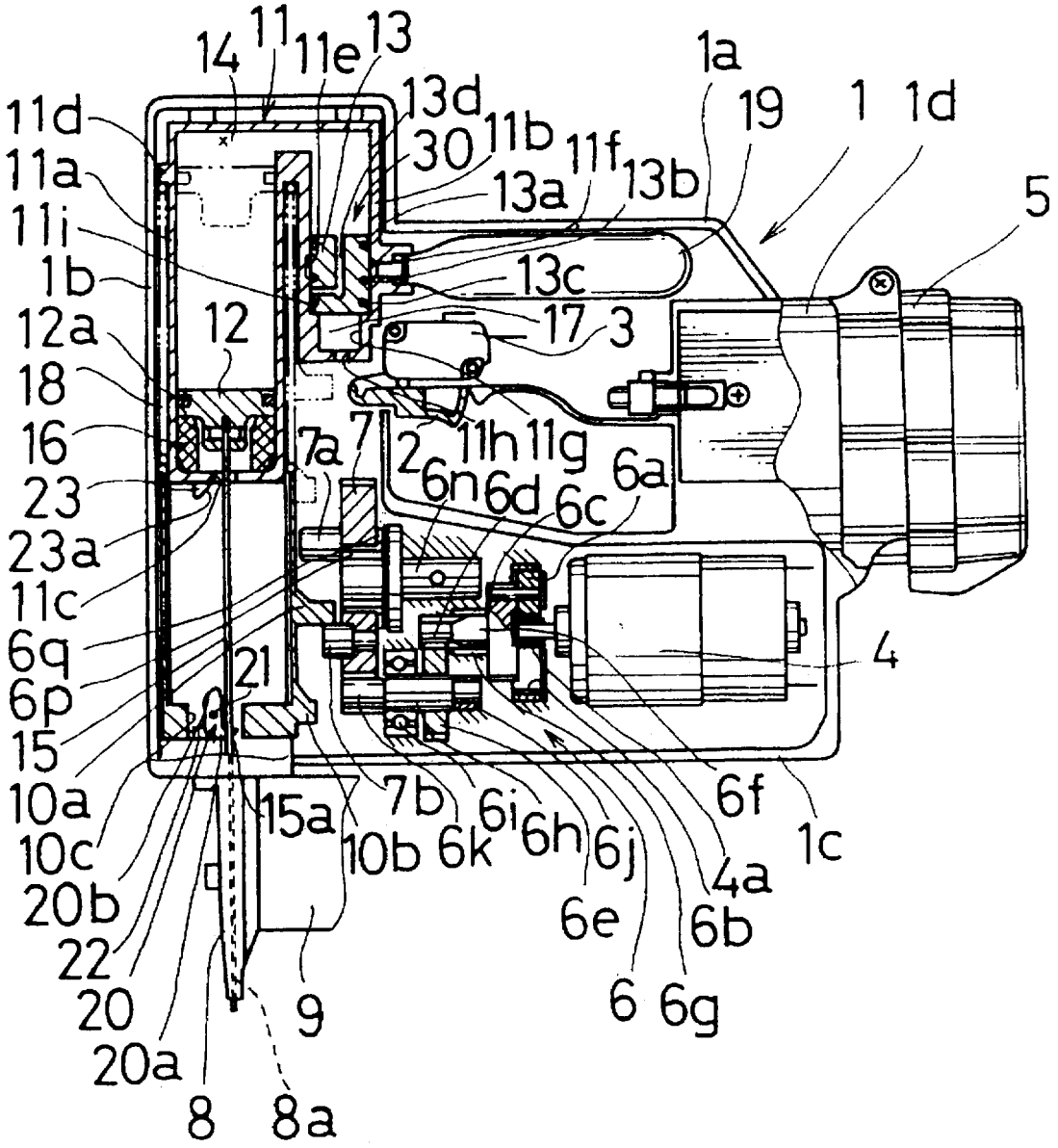
FIG. 1 is a side view, with one of halves of a housing removed, of a nailer according to a first embodiment of the present invention.

A nailer according to this embodiment is shown in FIG. 1 in its whole view and includes a housing 1 split into two halves. In FIG. 1, the nailer is shown with one of the halves of the housing 1 removed.

The housing 1 has a grip portion 1*a* on the upper side, a cylinder housing portion 1*b* on the front side (left side FIG. 1), a drive housing portion 1*c* on the lower side, and a battery housing portion 1*d* on the rear side (right side in FIG. 1). A trigger 2 is mounted on the lower side of the grip portion 1*a* and is adapted to be pulled by an operator, so that a microswitch 3 is turned on for starting a motor 4 disposed within the drive housing portion 1*c*. The nailer has a battery 5 which is set into the battery housing portion 1*d* and which serves as a power source for driving the motor 4. The battery 5 can be removed from the battery housing portion 1*d* for charging purposes. The battery 5, the microswitch 3 and the motor 4 are connected to each other by an appropriate electrical circuit (not shown).

Figure 3:
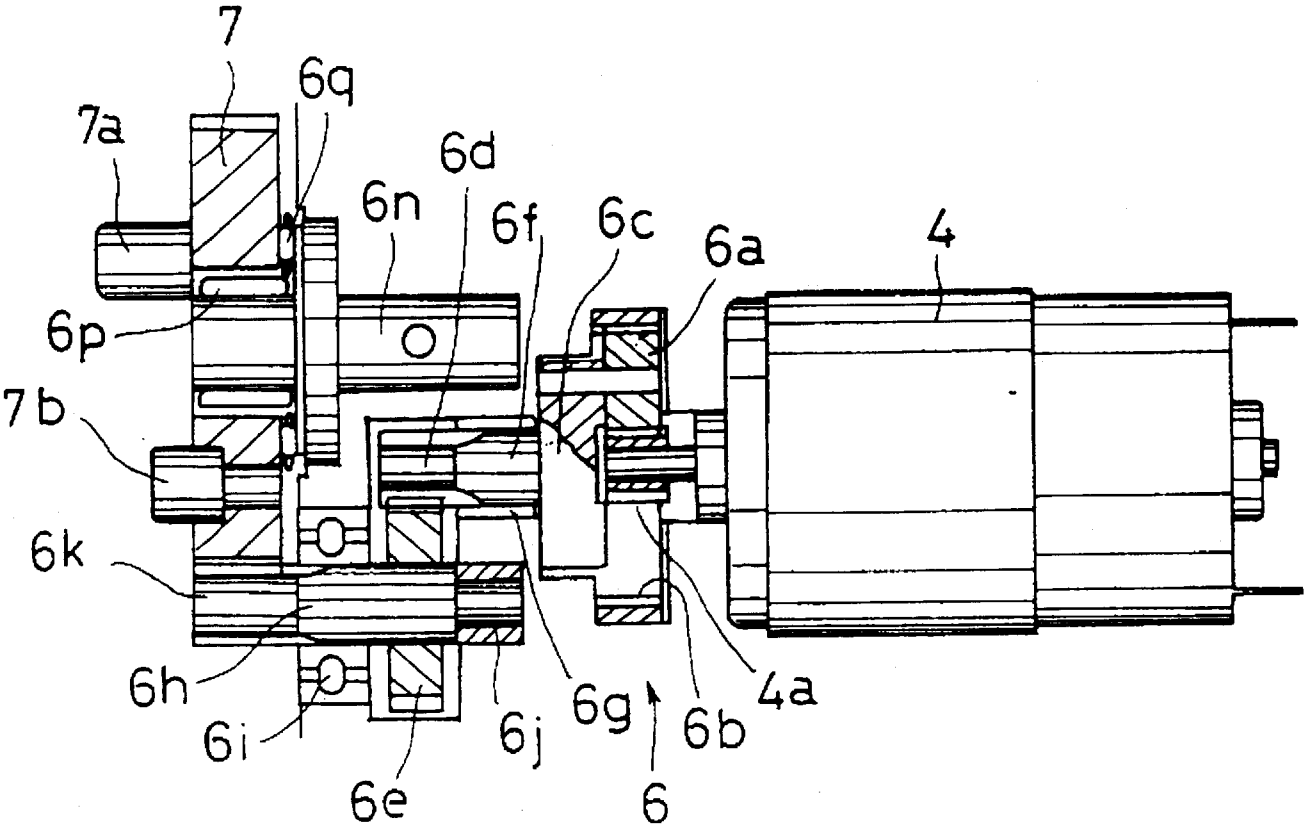
FIG. 3 is an enlarged view of a motor and its associated drive device of the nailer.

A drive mechanism is provided for moving a drive piston 12 and will now be explained. The drive mechanism includes the motor 4 and an actuation device 6. When the motor 4 is started, the actuation device 6 is actuated to move the drive piston 12 disposed within the cylinder housing portion 1*b*. The drive piston 12 will be explained later. As shown in FIG. 3, the actuation device 6 includes a planetary gear 6*a* which is in engagement with a pinion 4*a* fixed to an output shaft of the motor 4 and is in engagement with an internal gear 6*b* fixed to the housing 1. The planetary gear 6*a* is rotatably mounted on a first intermediate gear 6*c* in a position displaced from the center thereof. The first intermediate gear 6*c* is fixed to a first intermediate shaft 6*f* which is rotatably supported by the housing 1 by means of a bearing 6*g*.

A second intermediate gear 6*d* is formed integrally with a front end of the first intermediate shaft 6*f* and is in engagement with a third intermediate gear 6*e* which is fixed to a second intermediate shaft 6*h*. The second intermediate shaft 6*h* is rotatably supported by the housing 1 by means of bearings 6*i* and 6*j*. A fourth intermediate gear 6*k* is formed integrally with a front end of the second intermediate shaft 6*h* and is in engagement with a drive gear 7. The drive gear 7 is rotatably supported by a support shaft 6*n* by means of bearings 6*p* and 6*q*. Here, the bearing 6*q* is a thrust bearing. The support shaft 6*n* is fixed to the housing 1. A pair of crank pins 7*a* and 7*b* are fixed to the drive gear 7 and extend forwardly (leftwardly as viewed in FIG. 3) therefrom. The crank pins 7*a* and 7*b* are positioned on a circle about the center of the drive gear 7 but are spaced from each other by a predetermined angle in the circumferential direction. The forwardly protruding length of the crank pin 7*a* positioned on the upper side in FIG. 3 is greater than that of the crank pin 7*b* positioned on the lower side.

When the motor 4 is started, the drive gear 7 is rotated at a low speed, and the crank pins 7*a* and 7*b* are rotated along the circle about the center or the rotational axis of the drive gear 7 so as to vary their vertical height.

An intermediate member 10 is disposed within the cylinder housing portion 1*b* and has a square tubular configuration. The intermediate member 10 has a pair of engaging protrusions 10*a* and 10*b* formed integrally therewith and extending rearwardly from its rear surface. The engaging protrusion 10*a* is positioned upwardly of the engaging protrusion 10*b* and has the rearwardly extending length greater than that of the engaging protrusion 10*b*, so that the crank pin 7*b* having the smaller protruding length may not be brought to engage the engaging protrusion 10*b* although it may be brought to engage the engaging protrusion 10*a*. The engaging protrusion 10*b* having the smaller extending length may only be engaged by the crank pin 7*a* having the greater protruding length.

Figures 4A, 4B, 4C, 4D, 4E:
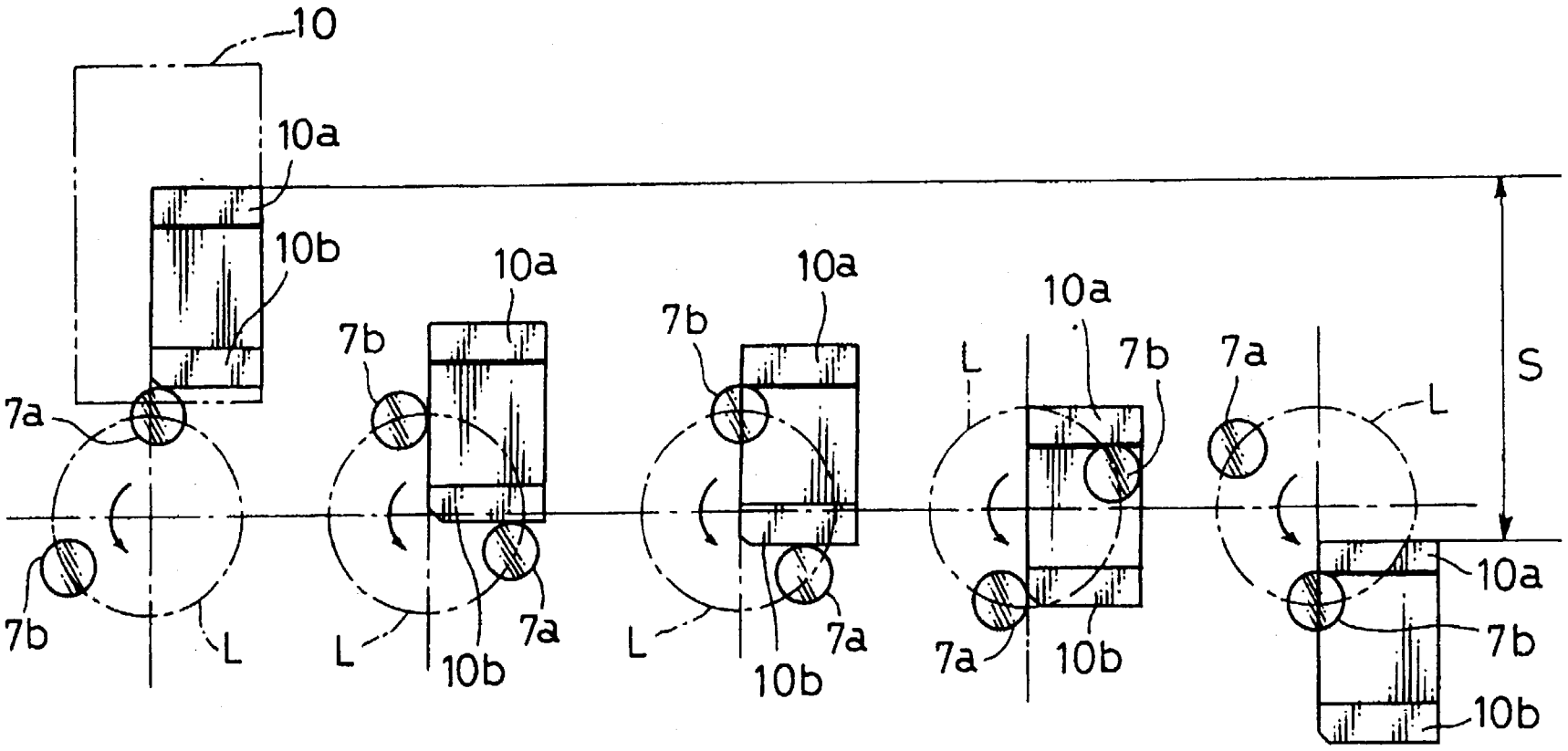
FIGS. 4A–4E are schematic views of a double-crank mechanism of the nailer as viewed in a direction of arrows IV—IV in FIG. 2 and showing various states of operation during the rotation of a drive gear.

With this construction, the crank pins 7*a* and 7*b* of the drive gear 7 and the engaging protrusions 10*a* and 10*b* cooperate to form a double-crank mechanism for moving the intermediate member 10 upwardly in a direction opposite to a direction for driving nails (not shown). Thus, when the drive gear 7 is rotated to vary the vertical positions of the crank pins 7*a* and 7*b*, the intermediate member 10 is moved vertically against a biasing force of a compression spring 18 which will be explained later. Such a vertical movement of the intermediate member 10 will now be explained with reference to FIG. 4 showing States (A) to (E) in sequence. In FIG. 4, L designates the moving path (rotational path) of the crank pins 7*a* and 7*b*, and the description will be made on the assumption that the drive gear 7 (not shown in FIG. 4) rotates in the direction indicated by arrows.

As the drive gear 7 is rotated, the crank pin 7*b* having a smaller protruding height is brought to engage the engaging protrusion 10*a* having the greater extending length (see State (A)). When the drive gear 7 is further rotated, the crank pin 7*b* varies its position upwardly, so that the intermediate member 10 is moved upwardly (see State (B)).

The crank pin 7*a* is brought to engage the lower side of the engaging protrusion 10*b* before the crank pin 7*b* reaches its uppermost position or the upper dead center (see State (C)), so that the intermediate member 10 is further moved upwardly by the crank pin 7*a*. After the crank pin 7*b* is further moved from its upper dead center to be disengaged from the engaging protrusion 10*a*, the intermediate member 10 is moved upwardly by the upward movement of the crank pin 7*a* (see State (D)). When the crank pin 7*a* reaches its upper dead center, the intermediate member 10 is positioned at its uppermost position (see State (E)).

Thus, during substantially one rotation of the drive gear 7, the intermediate member 10 is moved upwardly through engagement of the crank pin 7*b* with the engaging protrusion 10*a* and is then further moved upwardly through engagement of the crank pin 7*a* with the engaging protrusion 10*b*. With this double crank mechanism, a greater vertical stroke S of the intermediate member 10 can be obtained even if the drive gear 7 has a small diameter. When the drive gear 7 is further rotated from State (E) where the intermediate member 10 is in its uppermost position, the crank pin 7*a* is disengaged from the engaging protrusion 10*b*, so that the intermediate member 10 is brought to be free from the crank pins 7*a* and 7*b*. Thus, the intermediate member 10 is permitted to be moved downwardly (in the driving direction of fasteners).

Figure 2:
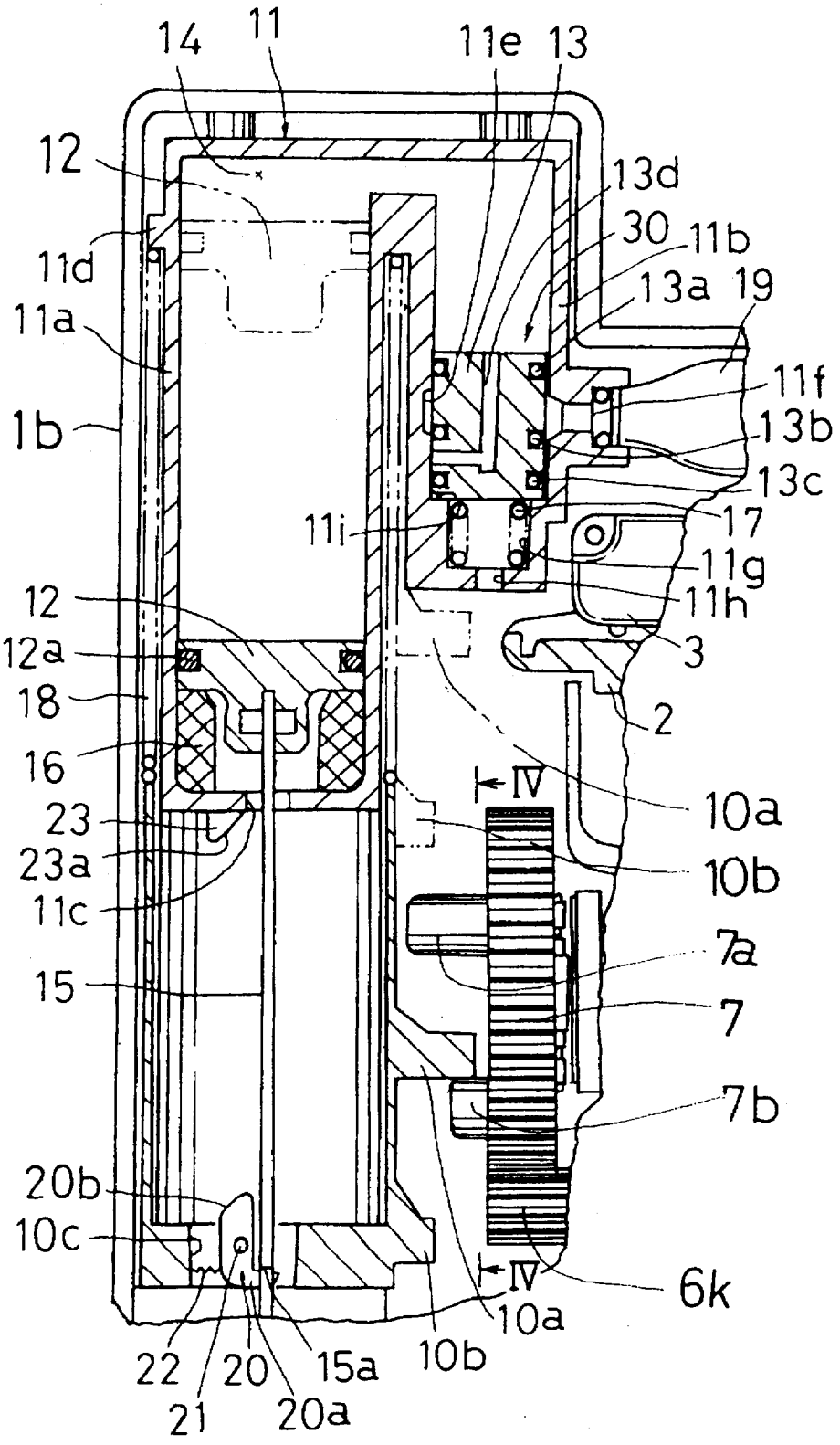
FIG. 2 is an enlarged view of a part of FIG. 1.

As shown in FIG. 2, a cylinder 11 as well as the intermediate member 10 is disposed within the cylinder housing portion 1*b*. The cylinder 11 is fixed to the cylinder housing portion 1*b* and includes a cylindrical main body 11*a* and an auxiliary cylinder portion 11*b*. The auxiliary cylinder portion 11*b* has an upper portion in communication with the upper portion of the main body 11*a* and extends in parallel to the main body 11*a*. The intermediate member 10 is square in section and is sized to slidably move along the outer surface of the main body 11*a*. The cylinder housing portion 1*b* is configured to provide a guide for vertical movement of the intermediate member 10.

The drive piston 12 is disposed within the main body 11*a* of the cylinder 11 and has a seal ring 12*a* mounted on its outer periphery. A damper 16 is disposed at the bottom of the main body 11*a* for reducing the impact force applied to the main body 11*a* when the drive piston 12 is moved to its lower dead center. An air replenishing piston 13 is disposed within the auxiliary cylinder portion 11*b* and has three seal rings 13*a*, 13*b* and 13*c* mounted on its outer periphery. The seal rings 13*a*, 13*b* and 13*c* are spaced from each other in the vertical direction. A compression coil spring 17 is disposed within the auxiliary cylinder portion 11*b* and is positioned on the lower side of the air replenishing piston 13 for normally biasing the air replenishing piston 13 upwardly by a predetermined force. An air chamber 14 is formed within the main body 11*a* of the cylinder 11 on the upper side of the drive piston 12 and is in communication with the interior of the auxiliary cylinder portion 11*b* on the upper side of the air replenishing piston 13. The air chamber 14 and the interior of the auxiliary cylinder portion 11*b* in communication with the air chamber 14 are sealed from the outside in an air-tight manner so as to prevent any leakage of the air to the outside.

Figure 5:
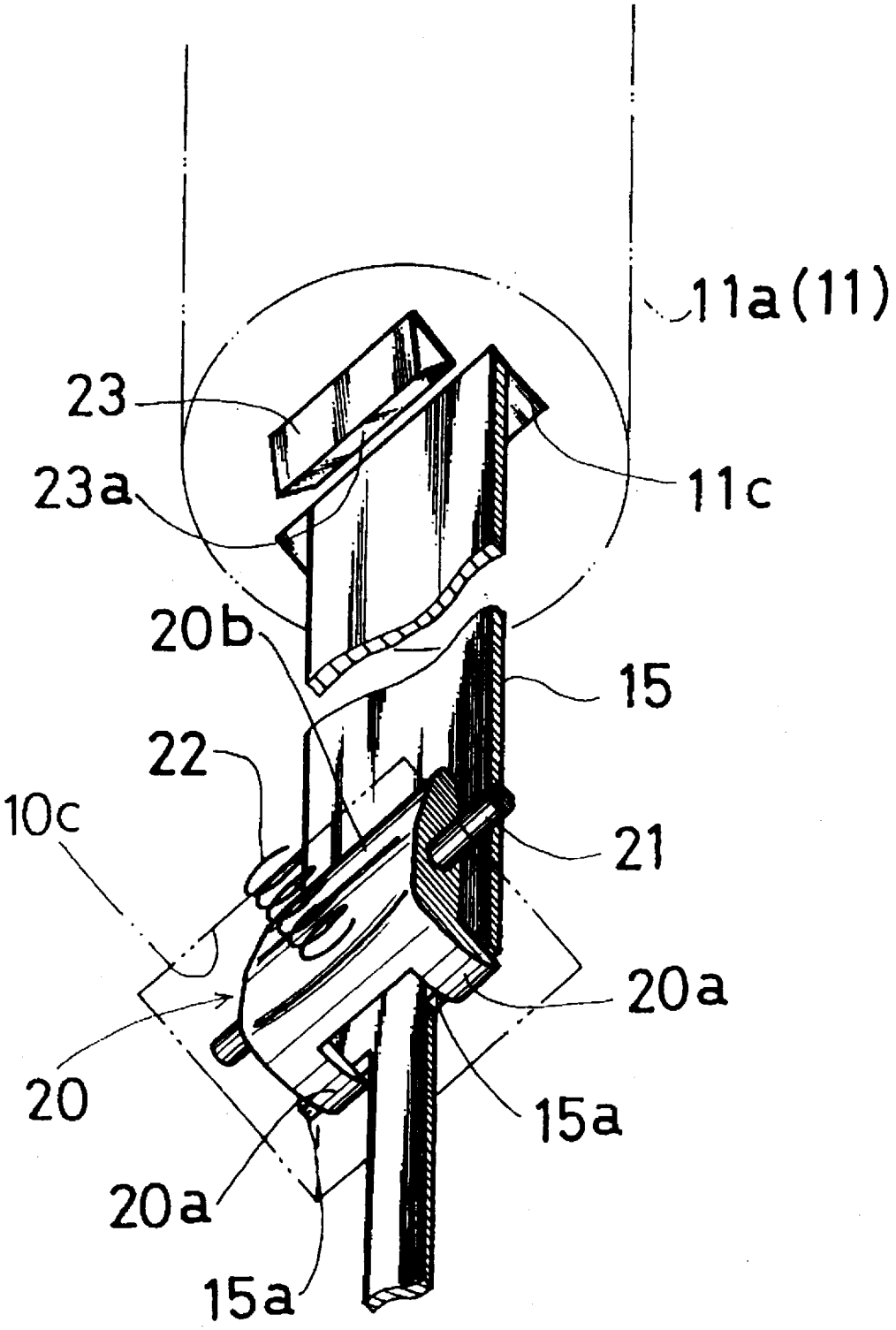
FIG. 5 is a perspective view of an engaging member and a releasing member of the nailer.

A driver 15 for driving nails is attached to the drive piston 12 and extends downwardly therefrom. As shown in FIG. 5, the driver 15 has a plate-like configuration and has a relatively small width. The driver 15 extends downwardly from the bottom of the main body 11*a* through an insertion window 11*c* formed therein and further extends into a guide hole 8*a* formed in a driver guide 8 through an insertion hole 10*c* formed in the bottom of the intermediate member 10. The driver guide 8 is fixed to the bottom of the housing 1 and extends downwardly therefrom, so that the driver 15 moves vertically along the guide hole 8*a* as the drive piston 12 is moved vertically within the main body 11*a* of the cylinder 11. Shoulders 15*a* are formed on both sides of the driver 15 at a position slightly lower than the central position in the vertical direction, so that the lower portion of the driver 15 has a narrower width.

As shown in FIG. 1, a nail magazine 9 is attached to the housing 1 along the lower side of the driver housing portion 1*c* and is positioned rearwardly of the driver guide 8. The nail magazine 9 stores a nail stick consisting of a series of nails bonded to each other. The nails are supplied to the guide hole 8*a* of the driver guide 8 one after another as the drive piston 12 is moved reciprocally, so that the driver 15 drives the nails one after another from the lower end of the driver guide 8.

A flange 11*d* is formed on the outer periphery of the upper portion of the main body 11*a* of the cylinder 11, and the compression coil spring 18 is interposed between the flange 11*d* and the upper end of the intermediate member 10 for normally biasing the intermediate member 10 in the downward direction. Thus, as the drive gear 7 is rotated, the intermediate member 10 is moved upwardly against the biasing force of the compression coil spring 18. When the crank pin 7*a* is moved to be disengaged from the engaging protrusion 10*b* (see State (E) in FIG. 4), the intermediate member 10 is moved to return to its lowermost position by the biasing force of the spring 18.

Figure 6:
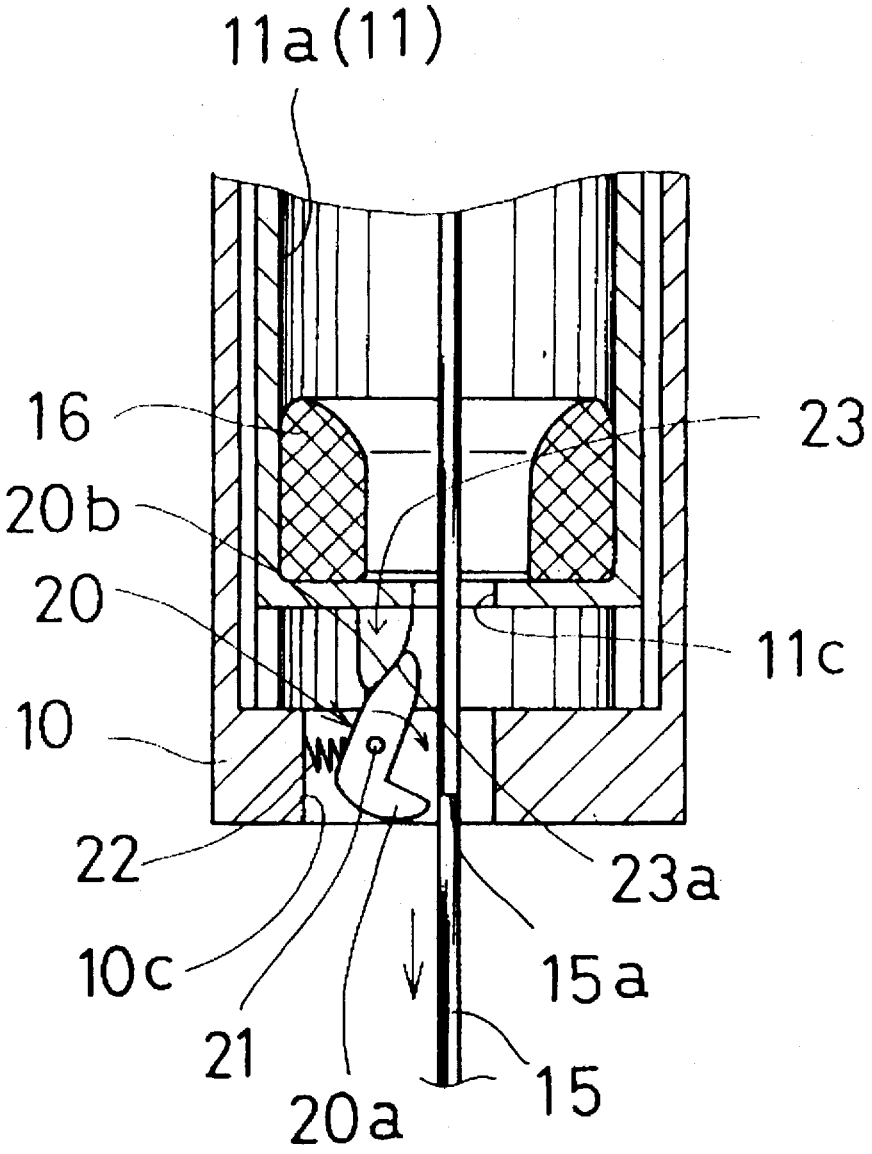
FIG. 6 is an enlarged view showing the operation of the releasing member.

As shown in FIGS. 2, 5 and 6, an engaging member 20 is mounted on the bottom of the intermediate member 10 and is positioned within the insertion hole 10*c*. The engaging member 20 is pivotally mounted on a peripheral wall of the insertion hole 10*c* by means of a pin 21. A compression coil spring 22 is interposed between the lower portion of the engaging member 20 and a front part of the peripheral wall of the insertion hole 10*c*, so that the engaging member 20 is biased in a counterclockwise direction in FIG. 2 or a direction to move the lower end of the engaging member 20 toward the driver 15.

As shown in FIG. 5, a pair of claws 20*a* are formed on the lower end of the engaging member 20 in a fork-like manner. The claws 20*a* are engageable with the shoulders 15*a* of the driver 15, so that the driver 15 is moved upwardly together with the intermediate member 10 which is moved upwardly by rotation of the drive gear 7. With such upward movement of the driver 15, the drive piston 12 is moved upwardly, so that the air within the air chamber 14 compressed.

On the other hand, as shown in FIG. 5, the upper part of the engaging member 20 has an inclined surface 20*b* inclined downwardly in the forward direction. A releasing member 23 having an inclined surface 23*a* for cooperation with the inclined surface 20*b* is mounted on the bottom of the main body 11*a* of the cylinder 11 at a position adjacent the insertion window 11*c*. When the intermediate member 10 is moved to its uppermost position as shown in FIG. 6, the inclined surface 20*b* of the engaging member 20 contacts the inclined surface 23*a* of the releasing member 23, so that the engaging member 20 is pivoted in the clockwise direction in FIG. 6 against the biasing force of the compression coil spring 22. With this pivotal movement, the claws 20*a* are disengaged from the shoulders 15*a* of the driver 15, so that the drive piston 12 is forced downwardly by the expanding force of the air compressed within the air chamber 14. The driver 15 is moved downwardly together with the drive piston 12 for driving the nails from the driver guide 8.

The timing of disengagement of the crank pin 7*a* from the engaging protrusion 10*b* and the timing of disengagement of the engaging member 20 from the driver 15 are adjusted such that the intermediate member 10 returns to its lowermost position after the drive piston 12 abuts on the damper 16 (after the nail has been driven).

An air replenishing device 30 is constituted by the auxiliary cylinder portion 11*b*, the auxiliary piston 13 and an air replenishing tank 19 and serves to supply the compressed air to the air chamber 14 when the pressure within the air chamber 14 is lower than a predetermined value. The auxiliary piston 13 includes an air supply channel 13*d* formed therein. The air supply channel 13*d* has one end open at the upper surface of the auxiliary piston 13 and has the other end open at the lateral surface of the auxiliary piston 13. An annular circumferential recess 11*e* is formed on an inner peripheral wall of the auxiliary cylinder portion 11*b* and is positioned between the uppermost seal ring 13*a* and the lowermost seal ring 13*c* of the auxiliary piston 13 throughout the movement of the auxiliary piston 13 as will be explained later. The circumferential recess 11*e* is open into a joint portion 11*f* to which the air replenishing tank 19 is connected.

The lower portion of the auxiliary cylinder portion 11*b* has a smaller inner diameter to form a spring chamber 11*g* within which the compression coil spring 17 is received to normally bias the auxiliary piston 13 in the upward direction. The spring chamber 11*g* is in communication with the outside through a communication hole 11*h* formed on its bottom, so that the atmospheric pressure is normally applied to the lower side of the auxiliary piston 13.

The upper end of the spring chamber 11*b* includes an annular surface 11*i* which serves to limit the downward movement of the auxiliary piston 13. When the auxiliary piston 13 is positioned in abutment on the annular surface 11*i*, the air supply channel 13*d* is prevented from communication with the circumferential recess 11*e* by means of the seal ring 13*b*, so that the air chamber 14 is prevented from communication with the air replenishing tank 19.

When the pressure within the air chamber 14 has a value lower than the predetermined value or when the pressure applied to the upper surface of the auxiliary piston 13 is reduced, the auxiliary piston 13 is moved upwardly by the biasing force of the spring 17, so that the air supply channel 13*d* is brought to communicate with the circumferential recess 11*e*. As a result, the pressurized air stored in the air replenishing tank 19 is supplied to the air chamber 14. Thus, the biasing force of the spring 17 and the position of the circumferential recess 11*e* relative to the seal ring 13*b* are determined such that the pressurized air is supplied from the air replenishing tank 19 when the pressure within the air chamber 14 is lower than the predetermined value.

The operation of the above embodiment will now be described.

When the operator pulls the trigger 2 to start the motor 4, the actuation device 6 is actuated, so that the intermediate member 10 is moved upwardly as the drive gear 7 is rotated. The driver 15 is moved upwardly together with the intermediate member 10 by means of the engaging member 20, so that the drive piston 12 moves upwardly within the main body 11*a* of the cylinder 11. Thus, the intermediate member 10 serves as a movable member which is vertically moved for moving the drive piston 12 as well as the driver 15.

The air within the air chamber 14 of the cylinder 11 is compressed as the drive piston 12 is moved upwardly. When the crank pin 7*a* of the drive gear 7 reaches its upper dead center (State (E) in FIG. 4), the intermediate member 10 as well as the drive piston 12 reaches its uppermost position (indicated by chain lines in FIG. 2), so that the air within the air chamber 14 is compressed to a predetermined pressure.

As the intermediate member 10 is moved upwardly as described above, the engaging member 20 moves toward the releasing member 23. When the drive piston 12 reaches its upper dead center, the inclined surface 20*b* of the engaging member 20 contacts the inclined surface 23*a* of the releasing member 23, so that the engaging member 20 is pivoted against the biasing force of the spring 22 to disengage its claws 20*a* from the driver 15.

When the engaging member 20 is thus disengaged from the driver 15, the drive piston 12 is moved downwardly by the pressure of the compressed air within the air chamber 14, so that the driver 15 is moved downwardly to drive the nail supplied to the driver guide 8 so as to eject the nail from the lower end of the driver guide 8.

After the nail has been driven or after the drive piston 12 abuts on the damper 16 at its lower dead center, the crank pin 7*b* of the drive gear 7 is disengaged from the engaging protrusion 10*a* of the intermediate member 10, so that the intermediate member 10 is moved downwardly by the biasing force of the compression coil spring 18. During the downward movement of the intermediate member 10, the engaging member 20 moves along the driver 15 with the engaging claws 20*a* abutting on the upper portion of the driver 15 having the greater width since the driver 15 has returned to the driving position shown by solid lines in FIG. 2.

When the intermediate member 10 returns to its lowermost position shown in FIG. 2, by virtue of the biasing force of the spring 22, the engaging member 20 is pivoted to again engage the shoulders 15*a* of the driver 15 by the claws 20*a*. Thus, the operation for driving one nail is completed.

As described above, with the nailer of this embodiment, the movement of the drive piston 12 for driving the nail is given by the force of the compressed air stored in the air chamber 14, and the compression of the air is attained by moving the drive piston 12 by means of the motor 4. Thus, the nailer of this embodiment does not require an external air source or does not require to be connected to a compressor by means of an air hose. In addition, since the nailer has the battery 5 as a power source for driving the motor 4, it is not necessary to be connected to an external power source by means of a cord. This means that the nailer of this embodiment is hoseless and cordless.

Additionally, since the driving force is given by the compressed air and is not given by a spring as in the conventional power driven stapler, the downward moving speed of the drive piston 12 is greater than the moving speed which may be given by the spring, so that the reaction force applied to the nailer can be reduced.

Further, since the air replenishing device 30 is provided on the nailer of this embodiment, the compressed air is replenished from the air replenishing tank 19 when the pressure within the air chamber 14 has been reduced to have a value lower than the predetermined value during the use of the nailer for a long time, so that the air within the air chamber 14 can be compressed to have a constant pressure. Therefore, a stable driving operation can be performed.

A second embodiment of the present invention will now be described with reference to FIG. 7.

Figure 7:
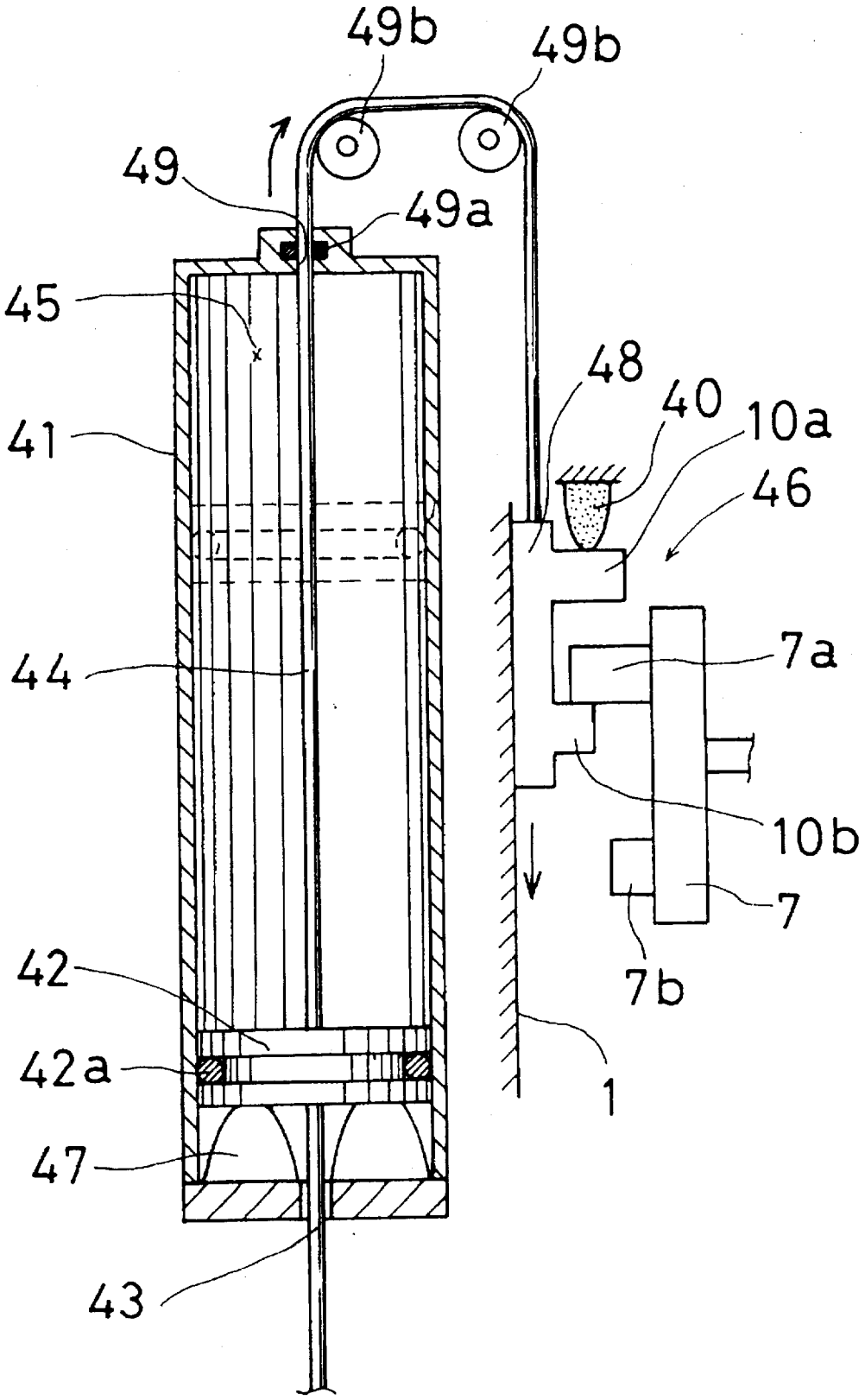
FIG. 7 is a vertical sectional view of the essential parts of a nailer according to a second embodiment of the present invention.

The second embodiment is a modification of the first embodiment, and FIG. 7 schematically shows only the essential construction of the second embodiment which is different from the first embodiment. Like members are given the same reference numerals and their description will not be repeated.

A nailer of this embodiment includes a cylinder 41 which corresponds to the cylinder 11 of the first embodiment and which includes a drive piston 42 disposed therein. The drive piston 42 has a seal ring 42*a* mounted thereon for sealing between the inner wall of the cylinder 41 and the drive piston 42, so that an air chamber 45 corresponding to the air chamber 14 of the first embodiment is formed within the cylinder 41. A driver 43 is connected to the lower end of the drive piston 42 and extends downwardly from the drive piston 42. A damper 47 is disposed at the bottom of the cylinder 41. A cord-like member or wire 44 has one end connected to the upper end of the drive piston 42 and has the other end connected to a movable member 48. The movable member 48 is vertically movably guided by a part of the housing 1 and has the engaging protrusions 10*a* and 10*b* for cooperation with the crank protrusions 7*a* and 7*b* to form a double crank mechanism 46 as in the first embodiment. The wire 44 extends upwardly from the drive piston 42 to the outside of the cylinder 41 through a hole 49 formed in the top of the cylinder 41. A seal 49*a* is provided for sealing between the wire 44 and the peripheral wall of the hole 49. In addition, guide rollers 49*b* are mounted on the housing 1 for providing the guide of the wire 44.

With this construction, the double crank mechanism 46 is driven by the motor 4 to move the drive piston 42 upwardly by means of the wire 44, so that the air within the air chamber 45 is compressed. When the drive piston 42 has been moved upwardly to a predetermined distance, the movable member 48 is disengaged from the drive gear 7. Therefore, the drive piston 42 is moved downwardly by the pressure of the air within the air chamber 45, and the driver 43 is moved to drive the nail. The movable member 48 abuts on a stopper damper 40 when the drive piston 42 reaches its lower dead center shown in solid lines in FIG. 7.

Thus, this embodiment does not require the engaging member 20 and the releasing member 23 as provided in the first embodiment. Therefore, the nailer of this embodiment is simple in construction.

Although not shown in the drawing, the air replenishing device 30 as in the first embodiment may be connected to the cylinder 41.

A third embodiment of the present invention will now be described with reference to FIGS. 8 and 9.

Figure 8:
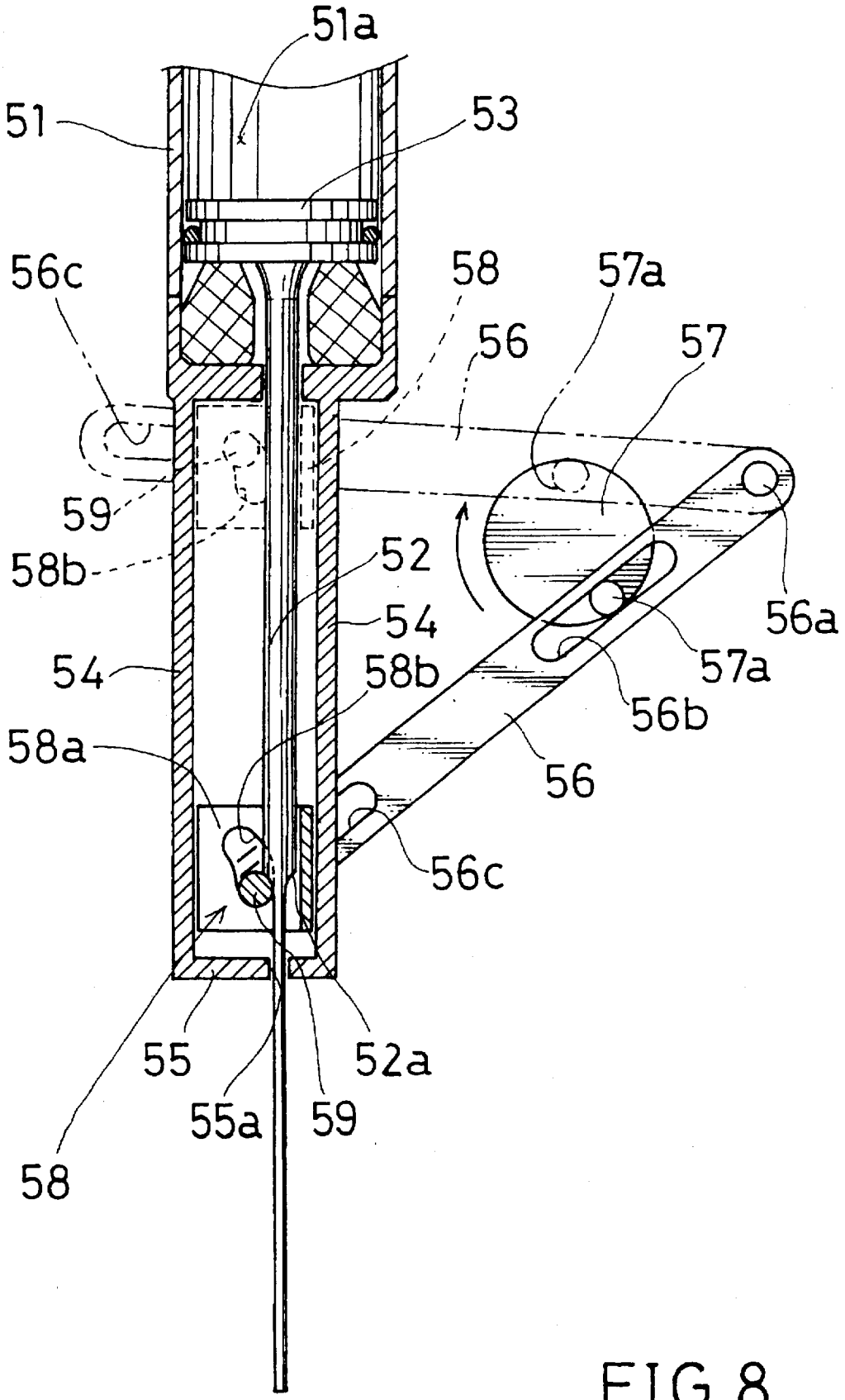
FIG. 8 is a vertical sectional view of the essential parts of a nailer according to a third embodiment of the present invention.
Figure 9:
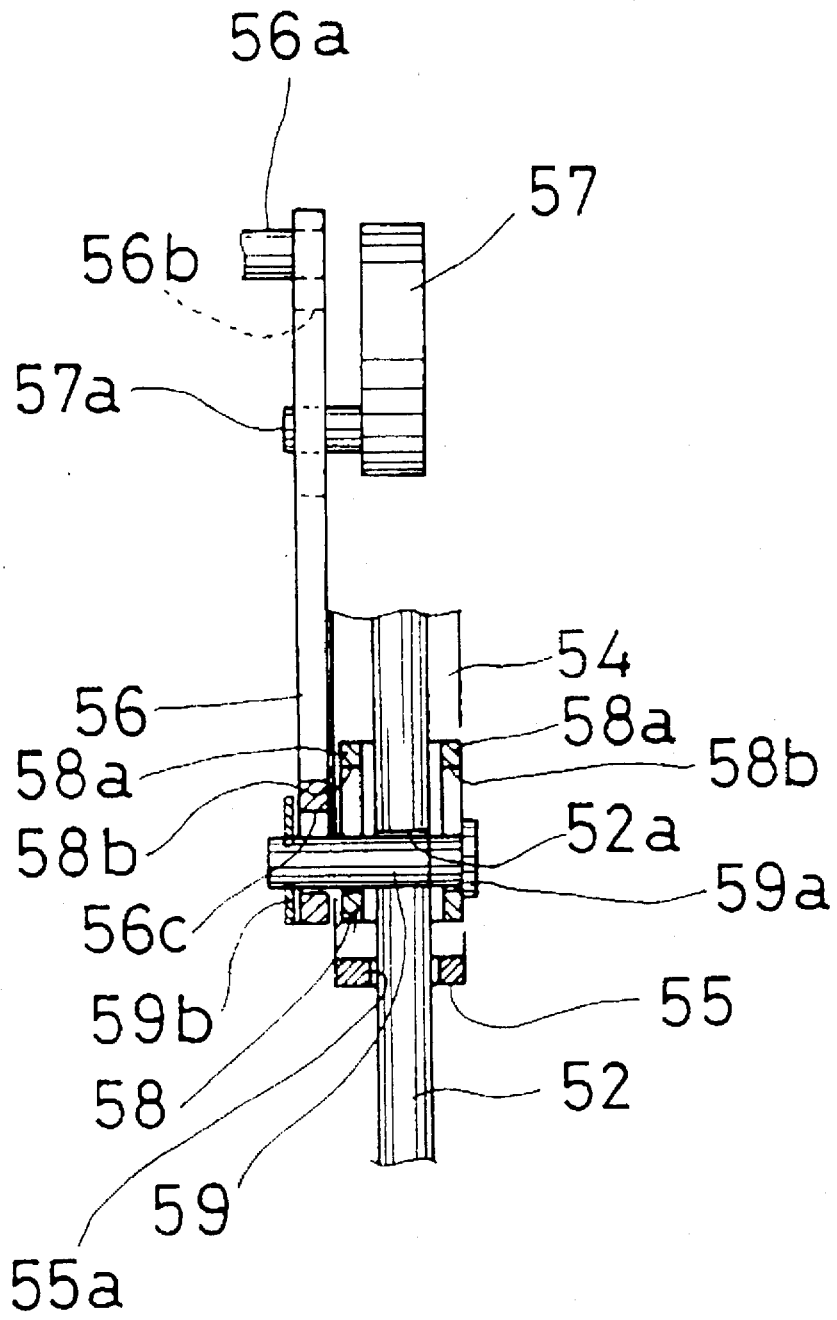
FIG. 9 is a front view of a link arm and its associated mechanism of the nailer shown in FIG. 8.

The third embodiment is a modification of the first embodiment, and FIGS. 7 and 8 show only the essential construction of the third embodiment which is different from the first embodiment.

A nailer of the third embodiment includes a cylinder 51 having a drive piston 53 disposed therein. A driver 52 is connected to the drive piston 53.

The driver 52 has an upper portion connected to the drive piston 53 and having a circular configuration in section. The driver 52 has a lower portion connected to the upper portion via a stepped portion 52*a* and having a flat plate-like configuration. The stepped portion 52*a* has arcuate inclined surfaces formed on both front and rear sides thereof.

A pair of parallel guide plates 54 extend downwardly from the lower end of the cylinder 51 and are spaced from each other by a predetermined distance. The lower ends of the guide plates 54 are connected to each other by a bottom plate 55. The driver 52 extends downwardly between the guide plates 54, and the flat plate-like lower portion of the driver 52 extends downwardly from an insertion hole 55*a* formed in the bottom plate 55.

A movable member 58 having a substantially U-shaped configuration in front view is vertically movably guided between the guide plates 54. The movable member 58 has both side plates 58*a* positioned on both sides of the driver 52. Each of the side plates 58*a* has an arcuate slot 58*b* formed therein. The arcuate slot 58*b* is curved forward and upward in the direction away from the driver 52. An engaging pin 59 is inserted into both arcuate slots 58*b* and extends therebetween. The engaging pin 59 is engageable with one of the inclined surfaces of the stepped portion 52*a* of the driver 52 when the engaging pin 59 is in a lower position of the arcuate slots 52*a* as shown by solid lines in FIG. 8, so that the engaging pin 59 serves to prevent the driver 52 from being moved downwardly. When the engaging pin 59 is moved to an upper position of the arcuate slots 52*a* as shown by chain lines in FIG. 8, the engaging pin 59 is disengaged from the stepped portion 52*a* so as to permit downward movement of the driver 52.

A link arm 56 is pivotally supported by the housing 1 (not shown in FIG. 8) by means of a pin 56*a*. The link arm 56 has a first elongated slot 56*b* formed therein in a position adjacent the pin 56*a*. The first elongated slot 56*b* extends longitudinally of the link arm 56. A guide protrusion 57*a* is in engagement with the first elongated slot 56*b* and is movable along the same. The guide protrusion 57*a* is fixed to a rotary wheel 57 in a position adjacent its outer periphery. The guide protrusion 57*a* is rotatably driven by the motor 4 (not shown in FIG. 8), so that the link arm 56 vertically reciprocally pivots about the pin 56*a*. The radial position of the guide protrusion 57*a* relative to the rotary wheel 57 and the distance between the rotational axis of the rotary wheel 57 and the axis of the pin 56*a* are determined such that the link arm 56 pivots upwardly from the position shown by solid lines in FIG. 8 to the position shown by chain lines and then pivots downwardly to return to the position shown by solid lines during one rotation of the rotary wheel 57.

A second elongated slot 56*c* is formed in the link arm 56 in a position adjacent one end thereof opposite to the pin 56*a* and extends longitudinally of the link arm 56. The engaging pin 59 supported between the side plates 58*a* of the movable member 58 is in engagement with the second elongated slot 56*c* so as to connect the link arm 56 to the movable member 58. As shown in FIG. 9, the engaging pin 59 has one end formed with an enlarged head 59*a* and has the other end on which a stopper ring 59*b* is fitted, so that the engaging pin 59 is prevented from removal.

With the nailer of the third embodiment, when the rotary wheel 57 is rotatably driven by the motor 4 in a clockwise direction as viewed in FIG. 8, the link arm 56 pivots upwardly from the position shown by solid lines, so that the movable member 58 moves upwardly from the position shown by solid lines. During this upward movement of the movable member 58, since the downward pressing force is applied from the driver 52 to the engaging pin 59 via the stepped portion 52*a*, the engaging pin 59 is held in the lower position of the arcuate slots 58*b* and between the stepped portion 52*a* and the lower ends of the arcuate slots 58*b*. Thus, the engaging pin 59 is held in engagement with the stepped portion 52*a*.

The driver 52 is therefore moved upwardly together with the movable member 58, so that the drive piston 53 moves upwardly within the cylinder 51 to compress the air within an air chamber 51*a* formed in the cylinder 51. As the pivotal angle of the link arm 56 increases, the movable member 58 moves upwardly, so that the pressure within the air chamber 51*a* increases.

When the movable member 58 is brought to abut on the bottom of the cylinder 51 as shown by chain lines in FIG. 8, the movable member 58 cannot be moved further upwardly. The link arm 56 is then further moved upwardly by a little distance, so that the driver 52 is further moved upwardly by a little distance and that the drive piston 53 reaches its upper dead center. Since the driver 52 is thus moved upwardly while the movable member 58 is held in position, the engaging pin 59 moves upwardly along the arcuate slots 58*b* and is then disengaged from the stepped portion 52*a* of the driver 52.

When the engaging pin 59 is thus disengaged from the stepped portion 52*a* of the driver 52, the drive piston 53 is forced downwardly by the pressure of the air within the air chamber 51, so that the driver 52 is moved downwardly for driving the nail.

As the rotary wheel 57 is further rotated, the link arm 56 is pivoted downwardly, so that the movable member 58 and the engaging pin 59 are moved downwardly. When the pin 59 reaches a position confronting the stepped portion 52*a* of the driver 52, the pin 59 is moved to the lower ends of the arcuate slots 58*b* so as to again engage the stepped portion 52*a*. Thus, the driving operation for driving one nail is completed.

As described above, with the third embodiment, the drive piston 53 is moved downwardly by the compressed air within the air chamber 51*a*, and the compression of the air is performed by moving the drive piston 53 by means of the movable member 58 which is driven by the motor. Therefore, as with the nailers of the first and second embodiments, the nailer of this embodiment does not require an external air source and does not require to be connected to an external power source.

Various modifications may be made in the above embodiments.

For example, although the engaging member 20 of the first embodiment includes the claws 20*a* for engagement with the shoulders 15*a* of the driver 15, the claws 20*a* may be replaced by retractable pins.

The double crank mechanism incorporated into the first and second embodiments for moving the intermediate member 10 and for pulling the wire 44 may be replaced by a rack and pinion mechanism in combination with a motor having a clutch mechanism or may be replaced by a rack and pinion mechanism having a pinion in which suitable number of teeth are omitted.

Additionally, although the above embodiments relate to nailers, the same constructions can be adapted to a stapler or the like.

Further, although in the above embodiments, the air is charged in the air chambers 14, 45 and 51*a* for forcing the drive pistons 12, 42 and 53, other gas such as $N_2$ gas and $CO_2$ gas may be used in place of the air. In such a case, the air replenishing tank 18 stores the same gas with that charged in the air chambers.

While the invention has been described with reference to preferred embodiments thereof, it is to be understood that modifications or variations may be easily made without departing from the spirit of this invention which is defined by the appended claims.

What is claimed is:

1. A fastener driving tool comprising:

a cylinder;

a drive piston reciprocally movable within said cylinder and having a driver connected thereto, said driver being movable to drive fasteners when said drive piston is moved in a driving direction;

said drive piston defining a gas chamber in said cylinder for accommodating a gas; and drive means for moving said drive piston from a first position to a second position in a direction opposite to said driving direction for compressing the gas within said gas chamber, said drive means being operable to permit movement of said drive piston in said driving direction by the pressure of the gas compressed within said gas chamber when said drive piston reaches said second position;

said drive means including a motor and a drive mechanism provided between the motor and the driving piston for converting rotation of the motor into movement of the drive piston from said first position to said second position;

said drive mechanism including:

an intermediate member movable relative to said cylinder in an axial direction of the cylinder between a third position and a fourth position corresponding to said first position and said second position of said drive piston, respectively;

biasing means for normally biasing said intermediate member toward said third position in the axial direction;

engaging means for engaging said drive piston with said intermediate member during the movement of the intermediate member from said third position to said fourth position; and releasing means for disengaging said engaging means when the intermediate member reaches the fourth position.

2. The fastener driving tool as defined in claim 1 further including gas replenishing means for replenishing the gas to said gas chamber when the pressure of the gas within said gas chamber is lower than a predetermined pressure.

3. The fastener driving tool as defined in claim 2 wherein said gas replenishing means includes an auxiliary cylinder connected to said cylinder, a gas replenishing tank connected to said auxiliary cylinder, and an auxiliary piston disposed within said auxiliary cylinder and movable between an open position and a closed position in response to the pressure of the gas within said gas chamber, said auxiliary piston in said open position permitting communication between said gas chamber and said auxiliary tank, and said auxiliary piston in said closed position preventing communication between said gas chamber and said auxiliary tank.

4. The fastener driving tool as defined in claim 1 further including a battery for driving said motor.

5. The fastener driving tool as defined in claim 1 wherein said drive mechanism further includes a rotary member rotatably driven by said motor and having at least one protrusion mounted thereon in a position displaced from a rotational axis of said rotary member, said rotary member being operable to move said intermediate member from said third position to said fourth position through engagement of said intermediate member by said at least one protrusion, and said intermediate member being brought to be disengaged from said at least one protrusion after said driving piston has been disengaged from said intermediate member by said releasing means.

6. The fastener driving tool as defined in claim 1 wherein said intermediate member has a cylindrical configuration coaxial with said cylinder and is axially slidably movable along an outer wall of said cylinder.

7. The fastener driving tool as defined in claim 1 wherein said engaging means includes an engaging claw provided on said intermediate member and movable between an engaging position for engagement with said driver and a disengaging position from said driver, and said releasing means includes a releasing member provided on said cylinder and operable to move said engaging claw from said engaging position to said disengaging position when said intermediate member has been moved to said fourth position from said third position.

* * * * *